US005651271A

United States Patent [19]

Fraysse et al.

[11] Patent Number: 5,651,271

[45] Date of Patent: Jul. 29, 1997

[54] PROCESS FOR THE SEPARATION OF A GAS MIXTURE BY CRYOGENIC DISTILLATION

[75] Inventors: Philippe Fraysse, Fontenay sous Bois; Mike De L'Isle, Paris; Daniel Rousseau, Villiers sur Marne, all of France

[73] Assignee: L'Air Liquide, Societe Anonyme Pour L'Etude et L'Exploitation Des Procedes Georges Claude, Paris Cedex, France

[21] Appl. No.: 574,128

[22] Filed: Dec. 18, 1995

[30] Foreign Application Priority Data

Dec. 23, 1994 [FR] France ..... 94 15608

[51] Int. Cl.[6] ..... F25J 3/00

[52] U.S. Cl. ..... 62/646; 62/650; 62/651

[58] Field of Search ..... 62/646, 650, 651

[56] References Cited

U.S. PATENT DOCUMENTS

| | | | |
|---|---|---|---|
| 3,327,488 | 6/1967 | Pervier | 62/650 |
| 4,072,023 | 2/1978 | Springmann | 62/650 |
| 4,099,945 | 7/1978 | Skolaude | 62/650 |
| 4,367,082 | 1/1983 | Tomisaka et al. | 62/650 |

FOREIGN PATENT DOCUMENTS

| | | |
|---|---|---|
| 0 456 575 | 11/1991 | European Pat. Off. . |
| 0 624 765 | 11/1994 | European Pat. Off. . |
| 54-103777 | 8/1979 | Japan . |
| 2 274 407 | 7/1994 | United Kingdom . |

*Primary Examiner*—Ronald C. Capossela
*Attorney, Agent, or Firm*—Young & Thompson

[57] ABSTRACT

In order to precool a flow of gas to be distilled, before a purification stage, it is sent into an exchanger (5) where it is cooled by heating a flow of refrigerant (13B). At least a part of this refrigerant has its pressure reduced before cooling the unpurified gas and may be a fraction of the gas to be distilled or a product of the distillation. It is preferably a cycle gas of the system. This arrangement makes it possible to obviate a refrigerating unit.

21 Claims, 2 Drawing Sheets

PROCESS FOR THE SEPARATION OF A GAS MIXTURE BY CRYOGENIC DISTILLATION

FIELD OF THE INVENTION

The present invention relates to a process for the separation of a gas mixture containing oxygen and nitrogen by distillation in a cryogenic apparatus. In particular, it relates to processes of the type including the stages of:

compressing the gas mixture;

purifying the compressed gas mixture with respect to water and carbon dioxide;

cooling the purified gas mixture to close to its dew temperature;

distilling the cooled gas mixture in at least one distillation column; and supplying the cooling power of the apparatus by a refrigeration system other than a refrigerating unit, in which at least a part of the gas mixture is cooled between the compression and purification stages by indirect heat exchange with a flow of refrigerant which is a product of the distillation column or which constitutes a part of the gas mixture to be distilled.

BACKGROUND OF THE INVENTION

Climatic conditions are important in the design of air separation apparatuses and, more generally, in cryogenic apparatuses. More particularly, the cooling water of the refrigerators of the various compression stages of the air compressor can vary according to the climate and even between day and night, significantly in some countries, so that, in these countries, fluctuations in the temperature of the water of the order of 15° C. can be recorded.

These variations are currently resolved by installing, at the outlet of the final refrigerator, a refrigerating unit supplying the additional cooling power which the water was not capable of giving.

Refrigerating units have the drawback of being an expensive investment and of using at least one rotating machine, which is unreliable and heavily consumes energy.

U.S. Pat. No. 4,375,367 describes a system in which a flow of air to be distilled is cooled, before being purified, by recycling the air produced by the purification system. Nevertheless, the use of a refrigerating unit is indispensable in this case.

EP-A-0,624,765A discloses a system which makes it possible to substitute for the refrigerating unit a system for heat exchange with a flow of pressurized fluid originating from the air separation installation. The use of a cycle fluid for cooling the air upstream of the purification system is not described.

This patent application also does not disclose an installation in which the air is precooled in an auxiliary exchanger with only one other fluid.

J-A-54,103,777 describes the use of a flow of nitrogen originating from a distillation column for cooling the sir to be purified.

EP-A-0,505,812 discloses that a flow of air to be purified can be cooled with a flow of purified air, before the latter has its pressure reduced.

SUMMARY OF THE INVENTION

The object of the invention is to provide a solution capable of overcoming these drawbacks, which is to say:

to provide supplementary cooling power which is less expensive in terms of investment and energy and to allow refrigeration of the air at constant temperature (approximately 25° C.) before it is purified by adsorption.

To this end, the subject of the invention is a process as described above, characterized in that liquid is produced as final product and the pressure of at least a part of the refrigerant is reduced in a pressure-reduction machine before it exchanges heat with the unpurified gas mixture.

The proposed solution is applicable to all apparatuses for the distillation of a gas mixture containing oxygen and nitrogen and which, for this purpose, use a refrigeration cycle, for example a gas mixture or nitrogen. It is well suited to apparatuses for the production of liquid.

The invention is applicable in particular to small apparatuses for the production of liquid by air distillation, which use a nitrogen cycle capable of supplying to the air the required additional cooling power to refrigerate it to its purification temperature.

The invention may consist in installing, at the outlet of the final refrigerator of the air compressor, an auxiliary exchanger making it possible, for example, to exchange heat between the compressed air and a fraction of the cycle nitrogen taken at an intermediate level of a main exchanger. The compressed air is thus cooled by the cycle nitrogen which is heated in this auxiliary exchanger, then remixed with the rest of the cycle nitrogen having continued to be heated in the main exchanger.

If it is desired to keep the temperature difference at the hot end of the main exchanger constant and to withdraw a fraction of the cycle nitrogen at an intermediate level of the main exchanger, it is necessary to increase the rate of flow of the cycle fluid in this exchanger.

Overall, this solution affords an investment saving of the order of 1%.

The process may include one or more of the following characteristics:

the refrigeration cycle is a nitrogen cycle;

the refrigerant with which the gas mixture exchanges heat is the cycle fluid;

the rate of flow of the refrigerant is adjusted to keep the temperature of the gas mixture part constant;

the gas mixture is purified with respect to water and carbon dioxide by a permeation and/or adsorption system;

the flow of fluid is a flow of nitrogen produced by a medium-pressure column of a double distillation column;

all the refrigerating power of the apparatuses is supplied by at least one refrigeration cycle;

after at least a part of the gas mixture has been cooled, the flow of fluid is liquefied and injected into the distillation column.

A further subject of the invention is an installation for the separation of a gas mixture containing nitrogen and oxygen by cryogenic distillation, including a compressor, a purification system, a main exchanger, at least one distillation column, means constituting a refrigeration system and an auxiliary exchanger which places the gas mixture compressed by the compressor in thermal exchange with a refrigerant originating either from the column or from the feed downstream of the purification system, characterized in that it comprises means for withdrawing a liquid product and a pressure-reduction machine for reducing the pressure of at least a part of the refrigerant upstream of the auxiliary exchanger.

The installation may include one or more of the following characteristics:

- a control valve for controlling the quantity of refrigerant sent to the auxiliary exchanger;
- the refrigerant circulates in the refrigeration cycle;
- the refrigerant is gaseous nitrogen originating from a medium-pressure column of a double column;
- the purification system operates by adsorption and/or permeation;
- means for liquefying at least a part of the refrigerant downstream of the auxiliary exchanger and sending at least a part of the liquefied fluid to the distillation column;
- at least one compressor which compresses the refrigerant downstream of the auxiliary exchanger.

BRIEF DESCRIPTION OF THE DRAWINGS

An exemplary embodiment of the invention will now be described with reference to the appended drawings, wherein FIGS. 1 and 2 schematically represent an air distillation installation according to the invention.

DETAILED DESCRIPTION OF THE DRAWINGS

Figure 1:
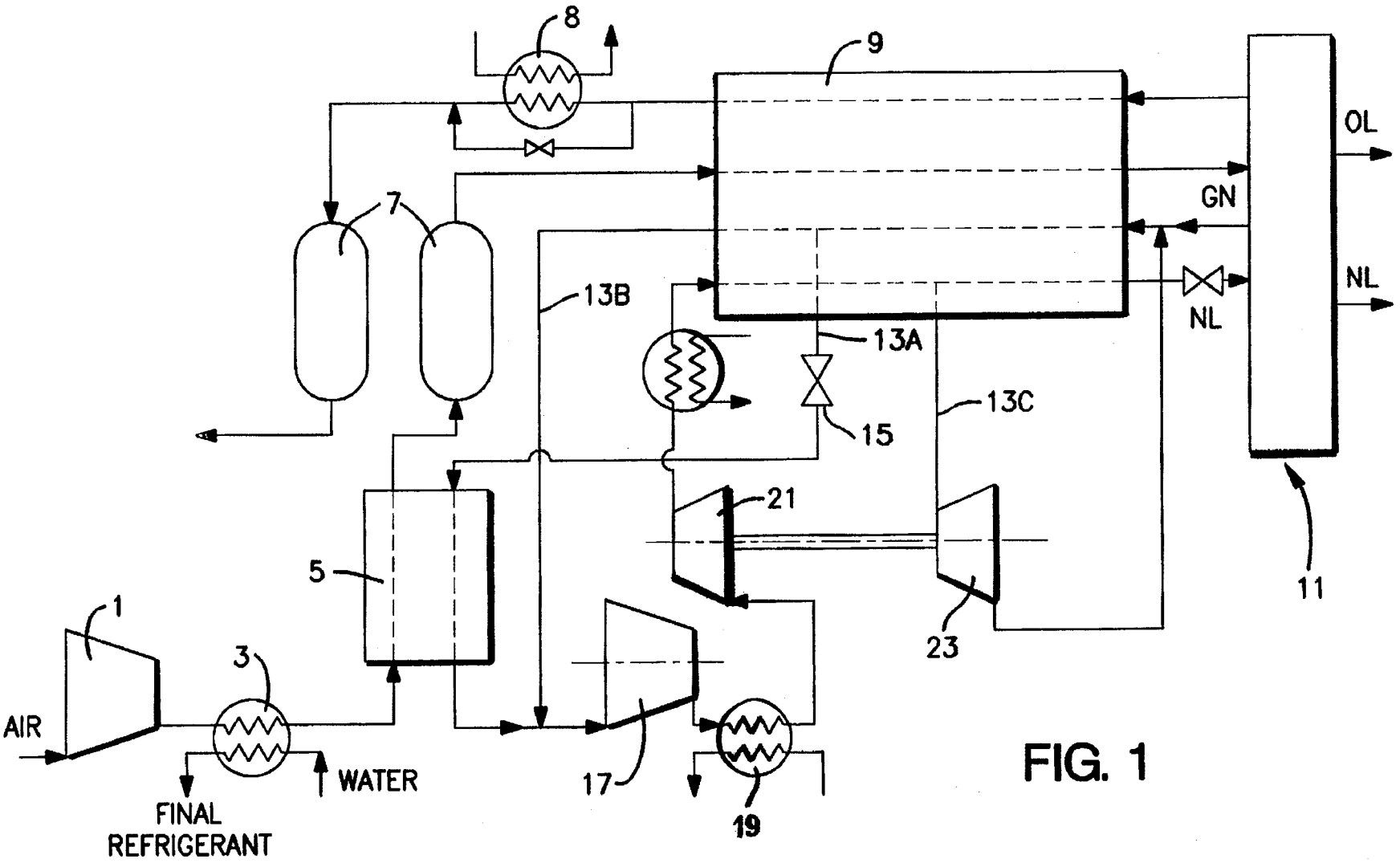

In the system of FIG. 1, a flow of air is compressed to $6\times10^5$ Pa by a compressor 1 and cooled to 40° C. in a water refrigerator 3. The flow then enters the auxiliary exchanger 5 where it cools to 25° C. by exchange of heat with a flow of nitrogen at $6\times10^5$ Pa. Separator pots (not shown) at the outlet of the refrigerator 3 and of the exchanger 5 make it possible to remove the condensed water from the treated air after cooling. After purification of the remaining water and of the carbon dioxide in an apparatus with a plurality of adsorbent beds 7, the air is cooled in the main exchanger 9 to close to its dew point, then sent to the vessel of a conventional double column 11 in which the air is separated into liquid oxygen, residual nitrogen at the pressure of the low-pressure column ($1.3\times10^5$ Pa) and essentially pure gaseous and liquid nitrogen at the pressure of the medium-pressure column ($6\times10^5$ Pa). The flow of substantially pure gaseous nitrogen is heated in the main exchanger 9 to a temperature of 22° C., from which the first flow 13A of pure nitrogen is withdrawn by the withdrawal valve 15 before passing into the auxiliary exchanger 5 where it cools the feed air to 25° C. The cycle nitrogen 13A is thus heated to 37° C. A second flow of pure gaseous nitrogen 13B continues to heat up to 35° C. in the main exchanger 9 and rejoins the first flow 13A after it has passed through the auxiliary exchanger 5. After being compressed $30\times10^5$ Pa by the compressor 17 and tooled in the exchanger 19, the combined flows are recompressed to 42 bar in the compressor 21 and cooled in the main exchanger 9. Partially heated, a third flow 13C of recompressed pure nitrogen has its pressure reduced in the turbine 23 from $42\times10^5$ Pa to $6\times10^5$ Pa and is recycled with the gaseous nitrogen withdrawn from the column at $6\times10^5$ Pa. The remaining flow of pure nitrogen liquefies in the exchanger 9 and serves as reflux for the medium-pressure column of the double column 11. The compressor 21 is coupled to the turbine 23. The residual nitrogen heats up in the main exchanger 9, is further heated in the electrical heater 8 and serves regenerate one of the adsorbent beds of the apparatus 7.

The cycle flow withdrawn from the main line 9 can be adjusted to an intermediate temperature by slaving the withdrawal valve 15 to the temperature of the air at the outlet of the auxiliary exchanger 5.

During winter, the water temperature may be 20°–22° C. Under these conditions, the compressed air will leave the final refrigerator of the compressor 1 at a temperature close to 25° C. and the valve 15 will be closed.

During summer, the water temperature may be 30°–32° C. and the air at the outlet of the final refrigerator of the compressor 1 will be at a temperature close to 40° C.

The cycle nitrogen 13A will then be sent at a sufficient rate of flow by opening the valve 15 enough for the air temperature at the outlet of the auxiliary exchanger 5 to be close to 25° C.

The system does not include a refrigerating unit, all the refrigerating power being supplied by the nitrogen cycle.

Figure 2:
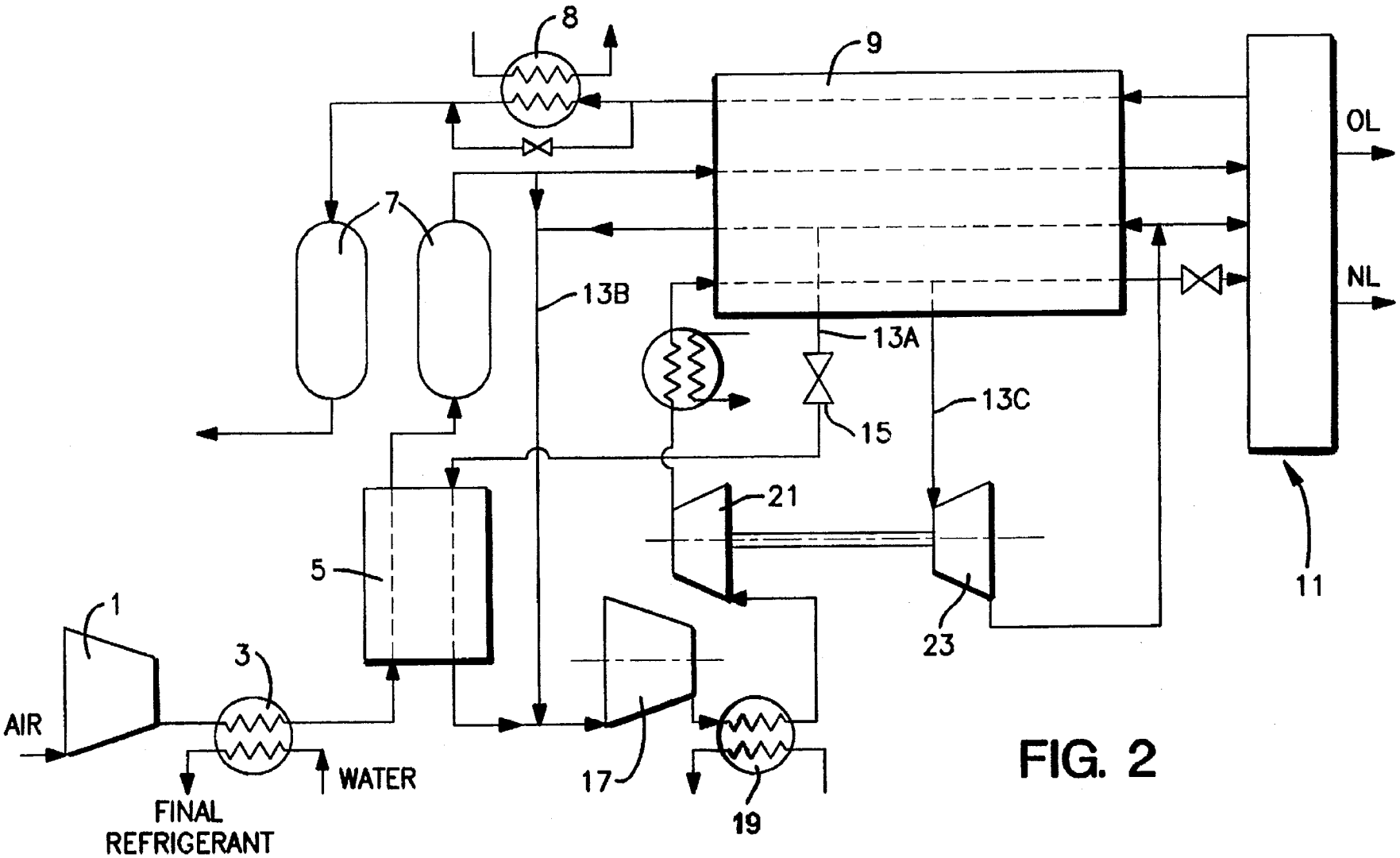

The system of FIG. 2 differs from that of FIG. 1 in that the nitrogen cycle is replaced by an air cycle (the gas mixture to be distilled). The equipment remains essentially the same.

After purification, the flow of air is compressed in the compressor 17 to $3\times10^5$ Pa, cooled in the exchanger 19 and recompressed by the compressor 21 to $42\times10^5$ Pa. The air is then cooled in the main exchanger 9. A flow of air 13C is withdrawn after being partially cooled, the remaining part of the air being therefore liquefied and sent to the column 11. The flow 13C has its pressure reduced to $6\times10^5$ Pa in the turbine 23. A part of this reduced-pressure air is sent to the column 11 as gas feed and the rest of the air is heated in the exchanger 9. A flow 13A of this air is partially heated, withdrawn by the valve 15 and sent to the auxiliary exchanger 5 where it cools all the feed air to 25° C. The flow 13A then rejoins the air to be compressed in the compressor 17. The flow 13B of air continues to heat up and rejoins the feed air downstream of the purification system 7.

It will be noted that, in the installations of FIG. 2, the refrigerating unit is replaced by another refrigeration system which is less expensive and easier to maintain.

We claim:

1. Process for the separation of a gas mixture containing nitrogen and oxygen by distillation in a cryogenic apparatus, comprising:

compressing the gas mixture in a compression stage;

purifying the compressed gas mixture with respect to water and carbon dioxide in a purification stage so as to obtain a purified gas mixture;

cooling the purified gas mixture to close to its dew temperature;

distilling the cooled gas mixture in at least one distillation column; and supplying the cooling power of the apparatus by a refrigeration system in which at least a part of the gas mixture is cooled between the compression and purification stages by indirect heat exchange with a flow of refrigerant which is a product of the distillation column or which constitutes a part of the gas mixture to be distilled, wherein liquid is produced as a final product and the pressure of at least a part of the refrigerant is reduced in a pressure-reduction machine before said refrigerant exchanges heat with unpurified gas mixture.

2. Process according to claim 1, wherein the refrigeration system is a refrigeration cycle.

3. Process according to claim 2, wherein the refrigerant with which the gas mixture exchanges heat is a refrigeration-cycle fluid.

4. Process according to claim 1, wherein the refrigeration system is an air cycle or a nitrogen cycle.

5. Process according to claim 1, further comprising adjusting the rate of flow of the refrigerant to keep the temperature of the gas mixture part constant.

6. Process according to claim 1, wherein the gas mixture is purified with respect to water and carbon dioxide by at least one of a permeation and adsorption system.

7. Process according to claim 1, wherein the flow of refrigerant is a flow of nitrogen produced by a medium-pressure column of a double distillation column.

8. Process according to claim 1, further comprising liquefying and injecting at least a part of the gas mixture or of the flow of refrigerant into the distillation column.

9. Process according to claim 1, wherein the refrigeration system includes the injection of a flow of cold liquid originating from an external source into the distillation column.

10. Process according to claim 1, wherein at least a part of the refrigerant is pressurized before its pressure is reduced.

11. Process according to claim 1, further comprising partially heating the refrigerant by cooling the purified gas mixture after the pressure of the refrigerant has been reduced.

12. Installation for the separation of a gas mixture containing nitrogen and oxygen by cryogenic distillation, comprising:

a compressor having an inlet for feeding the gas mixture and an outlet for compressed gas mixture;

an auxiliary exchanger fluidly connected to said outlet;

a purification system fluidly connected to said auxiliary exchanger;

a main exchanger fluidly connected to said purification system;

at least one distillation column fluidly connected to said main exchanger;

a refrigeration system operatively associated to said auxiliary exchanger, to said main exchanger, and to said distillation column;

said auxiliary exchanger including means for placing the compressed gas mixture in thermal exchange with a refrigerant originating from the distillation column or from a feed downstream of the purification system; and said installation further including means for withdrawing a liquid product, and a pressure-reduction machine for reducing the pressure of at least a part of the refrigerant upstream of the auxiliary exchanger.

13. Installation according to claim 12, further comprising control valve means for controlling the quantity of refrigerant sent to the auxiliary exchanger.

14. Installation according to claim 12, including means for circulating the refrigerant in the refrigeration system.

15. Installation according to claim 12, wherein the refrigerant is gaseous nitrogen originating from a medium-pressure column of a double distillation column or a part of the gas mixture.

16. Installation according to claim 12, wherein the purification system includes at least one of adsorption means and permeation means.

17. Installation according to claim 12, further comprising means for liquefying the refrigerant downstream of the auxiliary exchanger and for sending at least a part thereof to the distillation column.

18. Installation according to claim 12, wherein the refrigeration system includes at least one compressor means for compressing the refrigerant downstream of the auxiliary exchanger.

19. Installation according to claim 12, including means for injecting a flow of liquid originating from an external source into the distillation column.

20. Installation according to claim 12, wherein the auxiliary exchanger places the gas mixture in thermal exchange with a single refrigerant.

21. Installation according to claim 12, including means for pressurizing the part of the refrigerant intended to have its pressure reduced.

* * * * *